US011209020B2

(12) United States Patent
Panchenko et al.

(10) Patent No.: US 11,209,020 B2
(45) Date of Patent: Dec. 28, 2021

(54) FAN DEVICE

(71) Applicant: Valery Anatolyevich Panchenko, Tula (RU)

(72) Inventors: Valery Anatolyevich Panchenko, Tula (RU); Boris Valeryevich Panchenko, Tula (RU)

( * ) Notice: Subject to any disclaimer, the term of this patent is extended or adjusted under 35 U.S.C. 154(b) by 323 days.

(21) Appl. No.: 16/492,957

(22) PCT Filed: Mar. 13, 2018

(86) PCT No.: PCT/RU2018/000152

§ 371 (c)(1),
(2) Date: Sep. 11, 2019

(87) PCT Pub. No.: WO2018/169449

PCT Pub. Date: Sep. 20, 2018

(65) Prior Publication Data

US 2020/0018327 A1 Jan. 16, 2020

(30) Foreign Application Priority Data

Mar. 14, 2017 (RU) ..... RU2017108519

(51) Int. Cl.
*F04D 29/64* (2006.01)
*F04D 19/00* (2006.01)

(52) U.S. Cl.
CPC ..... *F04D 29/646* (2013.01); *F04D 19/002* (2013.01); *F05B 2240/91* (2013.01)

(58) Field of Classification Search
CPC ..... F04D 19/002; F04D 25/08; F04D 29/601; F04D 29/646; F24F 13/00; F05B 2240/91
See application file for complete search history.

(56) References Cited

U.S. PATENT DOCUMENTS

| | | | | |
|---|---|---|---|---|
| 3,200,731 | A | 8/1965 | Hart, Jr. | |
| 4,799,858 | A | 1/1989 | Shin-Chin | |
| 4,850,804 | A * | 7/1989 | Huang | F04D 29/601 416/246 |
| 5,547,343 | A | 8/1996 | Jane et al. | |
| 6,682,308 | B1 * | 1/2004 | Fei | F04D 29/403 415/213.1 |
| 9,335,061 | B2 * | 5/2016 | Avedon | F04D 29/542 |
| 2020/0018327 | A1 * | 1/2020 | Panchenko | F24F 13/00 |

FOREIGN PATENT DOCUMENTS

| | | | |
|---|---|---|---|
| CN | 201273292 | Y | 7/2009 |
| CN | 102338101 | A | 2/2012 |
| CN | 202468382 | U | 10/2012 |

(Continued)

*Primary Examiner* — Igor Kershteyn

(57) ABSTRACT

A fan device for a table of a user comprising a fan, a pivot pin for tilting and a mechanism for connection to a desktop in the form of two clips or a bracket with screws. It is positioned between the user and the desktop. The pivot pin for tilting is positioned beyond the edge of and within the thickness of the desktop, allowing for a maximum height of protrusion of the fan above and below the desktop less than the dimensions of the fan and allowing to direct the air flow to the greater part of the user area. The technical result is the decrease in the height of protrusion of the fan above and below the desktop.

7 Claims, 3 Drawing Sheets

(56) References Cited

FOREIGN PATENT DOCUMENTS

| | | | |
|---|---|---|---|
| CN | 203926081 | U | 11/2014 |
| CN | 204267326 | U | 4/2015 |
| CN | 104948480 | A | 9/2015 |
| CN | 205401195 | U | 7/2016 |
| JP | 0010292897 | A | 11/1998 |
| JP | 2002221185 | A | 8/2002 |

* cited by examiner

FAN DEVICE

The invention relates to fans for moving air at the table of a user in offices, public catering facilities, at home.

Known are a mini fan USB REMAX F-A, www.dx.com, as well as a rechargeable battery powered fan USB/5 3683, www.chinarostao.ru, comprising a fan the rotation plane and the rotation centre of which pass through the pivot pin for tilting, a leg of a minimum height positioned under the pivot pin for tilting beyond the edge of the desktop, a quick-detachable mechanism of connection to the desktop in the form a clip positioned under the leg and the fan.

The advantage is the possibility of directing the air flow to the greater part of the user area, which is more than 50% of the user area, since the tilt angle towards the user is more than 180°.

The disadvantage is the large height of the device, which is more than the dimensions of the fan above the surface of the desktop, and when the fan is positioned in the little-used area between the user and the desktop, where, for example, a sheet of writing paper or a computer are positioned, the fan will interfere with the line of sight and the user's hands.

Another disadvantage is that when the fan is positioned between the user and the desktop in all the fans with a clip, when directing the air flow down towards the user's hips, a part of the clip with dimensions ~70×25 mm protruding beyond the edge of the desktop is positioned on the path of the air flow, which interferes with the air flow considerably, scattering it.

The closest analogue is a rechargeable battery powered personal foldable desktop mini fan, www.ru.aliexpress.com, comprising a fan positioned beyond the edge and above the surface of the desktop, the rotation plane of the fan passes through the pivot pin for tilting positioned below the fan, the fan being connected to the desktop by means of a quick-detachable mechanism in the form a wire clip.

The advantage is the possibility of directing the air flow to the greater part of the user area.

The disadvantage is the large height of the device, which is more than the dimensions of the fan, above or below the desktop, when rotated by 180°, and when positioned between the user and the desktop the fan interferes with the line of sight and the user's hands or with the user's hips, when rotated.

The problem to which the invention is directed is to position the fan in a little-used area between the user and the desktop, while decreasing as much as possible the height of the fan:

- above the desktop in order to reduce interference with the line of sight and the user's hands;
- below the desktop in order to reduce interference with the user's hips;

At the same time, there should be a possibility of changing the direction of the air flow by more than 180° in order to direct it to the greater part of the user area;

At the same time, there should be a possibility of connecting the fan to the desktop by means of a quick-detachable mechanism, for example, a clip, a clamp or a permanent mechanism, for example, a bracket with screws.

The difficulty in solving the problem is that it is impossible to decrease the height of the fan positioned above or below the desktop by decreasing the overall dimensions of the fan, since the dimensions of the fan, other characteristics being equal, determines the required performance in the form of a created air flow.

Consequently, decreasing the height of the fan above or below the desktop up to the dimensions being less than the dimensions of the fan is only possible through a different position of the fan with respect to the desktop, for example, by positioning a part of the fan below the top surface or above the bottom surface of the desktop, for which it is necessary to position the pivot pin for tilting beyond the edge of and within the thickness of the desktop.

The difficulty is also in that it is necessary to position the pivot pin for tilting within the thickness of the desktop, while it varies from 8 mm to 60 mm in tables used in offices, public catering facilities, at home, www.yotube.com, such as a tempered glass desktop with photo printing, the latest par. www.rp.ru, a desktop from veneer—HORECA furniture, par. 1, while for special tables it varies even more, and this imposes additional conditions for solving the problem, without satisfying which the pivot pin for tilting can be positioned within the thickness of the desktop, but when raising or lowering the pivot pin for tilting from the middle of the desktop in extreme positions, the fan may protrude above or below the desktop more than the dimensions of the fan.

Solving these two interrelated problems simultaneously requires determining the dependence of the possible range for positions of the pivot pin for tilting on the desktop thickness, the change in the design of the mechanism for connecting the pivot pin for tilting to the desktop and determining the position of the fan with respect to the pivot pin for tilting.

The technical effect to be achieved upon solving this problem consists in a double-sided decrease in the height of protrusion of the fan above and below the desktop in the extreme fan positions up to a dimension being less than the dimension of the fan, allowing to direct the air flow to the greater part of the user area.

Said technical effect is achieved due to the fact that the known fan device for a table of a user, comprising a fan, a pivot pin for tilting and a mechanism for connection to a desktop is characterized in that the pivot pin for tilting is positioned beyond the edge of and within the thickness of the desktop, allowing for a maximum height of protrusion of the fan above and below the desktop less than the dimensions of the fan and allowing to direct the air flow to the greater part of the user area.

Besides, the pivot pin for tilting is provided with a mechanism for connection to the desktop in the form of two clips positioned on both sides of the fan.

At the same time, the rotation plane of the fan is displaced with respect to the pivot pin for tilting.

At the same time, the rotation plane and the rotation centre of the fan pass through the pivot pin for tilting.

Besides, the pivot pin for tilting is provided with a mechanism for connection to the desktop in the form of a bracket with screws.

At the same time, the rotation plane of the fan is displaced with respect to the pivot pin for tilting.

At the same time, the rotation plane and the rotation centre of the fan pass through the pivot pin for tilting.

The essential feature "the pivot pin for tilting is positioned beyond the edge of . . . the desktop" is expressed in general terms and means the position of the pivot pin for tilting closest to the desktop end, determined by the diameter of the pivot pin for tilting, the diameter of the friction washer and by the dimension and position of the fan with respect to the pivot pin for tilting.

The essential feature "the pivot pin for tilting is positioned . . . within the thickness of the desktop . . . " is expressed in general terms, since within this range a plurality of positions are possible, such as:

the most preferable position of the pivot pin for tilting in the middle of the desktop thickness, providing for the most compact, double-sided and equal decrease in the height of protrusion of the fan when tilting above and below the desktop up to the smallest possible height less than the dimensions of the fan, according to FIG. 1, 2, 3, 6, 7, 10, 11, 14, 15;

the position of the pivot pin for tilting when raised up from the middle of the desktop, providing for a double-sided unequal decrease in the height of protrusion of the fan when tilting below the desktop up to the smallest possible height, and above the desktop up to a height exceeding the smallest possible one, according to FIG. 4, 8, 12, 16;

the position of the pivot pin for tilting when lowered down from the middle of the desktop, providing for a double-sided unequal decrease in the height of protrusion of the fan when tilting above the desktop up to the smallest possible height, and below the desktop—up to a height exceeding the smallest possible one, according to FIG. 5, 9, 13, 17.

At the same time, the position of the pivot pin for tilting is determined according to the position of its geometric axis.

The essential feature " . . . allowing for a maximum height of protrusion of the fan above and below the desktop less than the dimensions of the fan . . . " is expressed in general terms, since it determines the range of raising or lowering the pivot pin for tilting from the middle of the desktop for the fans of various dimensions, various desktop thicknesses and various fan positions with respect to the pivot pin for tilting in order to provide for a maximum height of protrusion of the fan less than the dimensions of the fan for any combination of features.

The maximum height of protrusion of the fan above and below the desktop is determined by the largest dimensions of the fan used, for example, a fan sized 80×80×25 mm being one of preferable fans in terms of dimensions and performance, consequently, the maximum protrusion of this fan above or below the desktop in various positions of the pivot pin for tilting within the thickness of the desktop and various positions of the fan with respect to the pivot pin for tilting should be less than 80 mm, but for a fan of other dimensions the maximum height of protrusion will be different.

In the first position of the fan with respect to the pivot pin for tilting, in which the rotation plane of the fan is displaced with respect to the pivot pin for tilting, similarly to www.mvideo.ru, a table fan Scarlett SC—170 White, and the pivot pin for tilting is positioned in the middle of the desktop thickness, according to FIG. 1, 2, 3, the minimum height of protrusion=25 mm of the fan thickness+5 mm+5 mm thickness of protective grids on both sides of the fan+10 mm gap between the surface of the desktop and the surface of the fan for the intake air passage+~10 mm exceedance of the extreme lateral point of the fan during circular movement in the trajectory peak=55 mm, i.e. less than 80 mm, and this minimum and equal height of protrusion above and below the desktop is provided for under any thickness of the desktop.

The acceptable raising of the pivot pin for tilting from the middle of the desktop, depending on the thickness of the desktop, is determined by the following algorithm:

for a desktop thickness of 8 mm when the fan is raised up to the top surface of the desktop, the height of protrusion of the fan below the desktop will be minimum and equal to 55 mm, and the same above the desktop when the fan is tilted up will be equal to 55 mm+8 mm of the desktop thickness=63 mm, less than 80 mm;

for a desktop thickness of 20 mm when the fan is raised up to the top surface of the desktop, the height of protrusion below the desktop will be 55 mm, and the same above the desktop will be 55 mm+20 mm of the desktop thickness=75 mm, less than 80 mm;

for a desktop thickness of 30 mm when the fan is raised up to 5 mm from the middle of the desktop, the height of protrusion below the desktop will be 55 mm, and the same above the desktop will be 55 mm+30 mm of the desktop thickness−10 mm between the pivot pin for tilting and the top surface of the desktop=75 mm, less than 80 mm;

for a desktop thickness of 40 mm when the fan is raised up to 10 mm from the middle of the desktop, the height of protrusion below the desktop will be 55 mm, and the same above the desktop will be 55 mm+30 mm from the bottom surface of the desktop to the pivot pin for tilting−10 mm between the pivot pin for tilting and the top surface of the desktop=75 mm, less than 80 mm;

for a desktop thickness of 50 mm when the fan is raised up to 10 mm from the middle of the desktop, the height of protrusion below the desktop will be 55 mm, and the same above the desktop will be 55 mm+35 mm from the bottom surface of the desktop to the pivot pin for tilting−15 mm between the pivot pin for tilting and the top surface of the desktop=75 mm, less than 80 mm;

for a desktop thickness of 60 mm when the fan is raised up to 10 mm from the middle of the desktop, the height of protrusion below the desktop will be 55 mm, and the same above the desktop will be 55 mm+40 mm from the bottom surface of the desktop to the pivot pin for tilting−20 mm between the pivot pin for tilting and the top surface of the desktop=75 mm, less than 80 mm.

The acceptable height of lowering the pivot pin for tilting down from the middle of a desktop of any thickness is calculated in a similar way, wherein the minimum height of protrusion of the fan above the desktop is 55 mm, and ventilation devices are manufactured accordingly for different thicknesses of the desktops.

In the second fan position with respect to the pivot pin for tilting, in which the rotation plane and the rotation centre of the fan pass through the pivot pin for tilting, according to FIG. 6, 8, 9, 14, 16, 17, raising and lowering the pivot pin for tilting from the middle of the desktop are acceptable within the entire range of the desktop thickness under any thickness of the desktop, since a part of the fan is always below the top surface or above the bottom surface of the desktop in any position of the fan when tilted.

All the essential features, including combination thereof, are in a causal relationship with the technical effect, since in all the embodiments the position of the pivot pin for tilting beyond the edge and within the thickness of the desktop allows for different positions of the pivot pin for tilting with respect to the thickness of the desktop and various fan positions with respect to the pivot pin for tilting, providing for a smallest possible or decreased, less than the dimensions of the fan, height of protrusion of the fan in extreme positions above and below the desktop of any thickness, allowing to direct the air flow to the greater part of the user area and reducing interference with the user, which provides for obtaining the said new technical effect that is not obvious from the prior art.

Implementation of the mechanism for connecting the fan to the desktop in the form of two clips instead of one, as with analogues, is not an increase in the number of elements of the same type for enhancing the technical effect due to the presence of precisely these elements, since it does not enhance the known technical effect in the form of a reliable quick-detachable connection, which does not need to be enhanced, but allows for implementation of an essential feature with a position of the pivot pin for tilting and the fan between the clips, which do not interfere with air flow movement and do not create obstacles for the fan movements, which allows for a double-sided decrease in the height of the fan above and below the desktop.

All the figures illustrate a fan device in which "the pivot pin for tilting is positioned beyond the edge of and within the thickness of the desktop allowing the fan to protrude maximally above and below the desktop less than the dimensions of the fan . . . " with various positions of the pivot pin for tilting relative to the height of the desktop thickness according to the algorithm as described, including the minimal desktop thickness of 8 mm, the middle one of 20 mm or 30 mm, and the maximum one of 60 mm and two different positions of the fan with respect to the pivot pin for tilting.

In FIG. 1 the pivot pin for tilting is positioned in the middle of a 20 mm thick desktop, wherein " . . . is provided with a mechanism for connection to the desktop in the form of two clips positioned on both sides of the fan", wherein " . . . the rotation plane of the fan is displaced with respect to the pivot pin for tilting", shown in a side view, the extreme fan positions being illustrated with a dotted line, Scale1:2.5.

Figure 4:
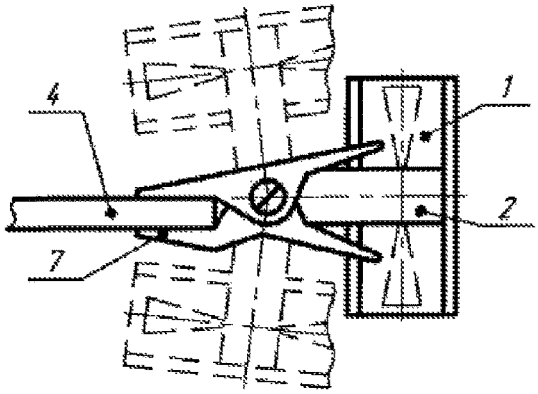

In FIG. 4 the pivot pin for tilting is raised up from the middle to the top surface of an 8 mm thick desktop, wherein " . . . is provided with a mechanism for connection to the desktop in the form of two clips positioned on both sides of the fan", wherein " . . . the rotation plane of the fan is displaced with respect to the pivot pin for tilting", shown in a side view.

Figure 5:
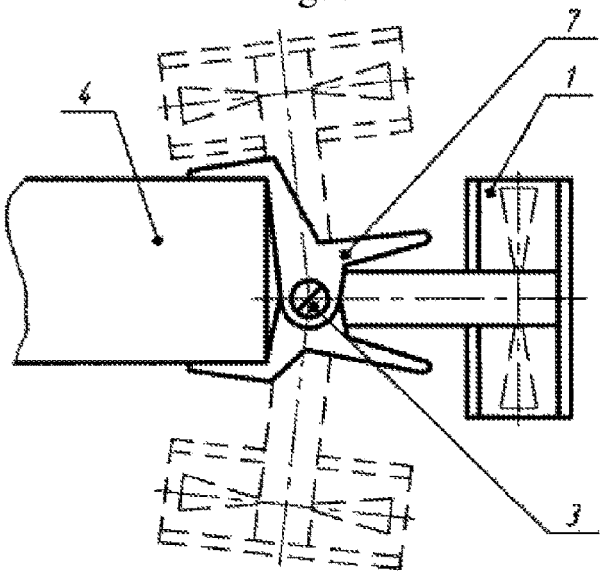

In FIG. 5 the pivot pin for tilting is lowered down by 10 mm from the middle of a 60 mm thick desktop, wherein " . . . is provided with a mechanism for connection to the desktop in the form of two clips positioned on both sides of the fan", wherein " . . . the rotation plane of the fan is displaced with respect to the pivot pin for tilting", shown in a side view.

Figure 6:
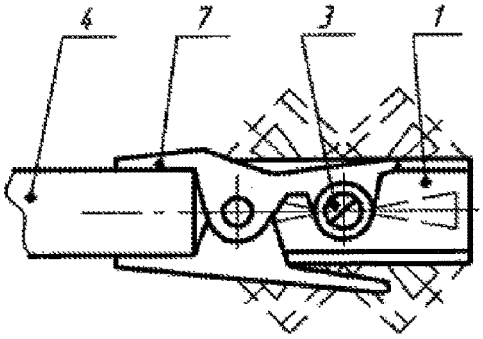

In FIG. 6 the pivot pin for tilting is positioned in the middle of a 30 mm thick desktop, wherein " . . . is provided with a mechanism for connection to the desktop in the form of two clips positioned on both sides of the fan", wherein " . . . the rotation plane and the rotation centre of the fan pass through the pivot pin for tilting", shown in a side view.

Figure 7:
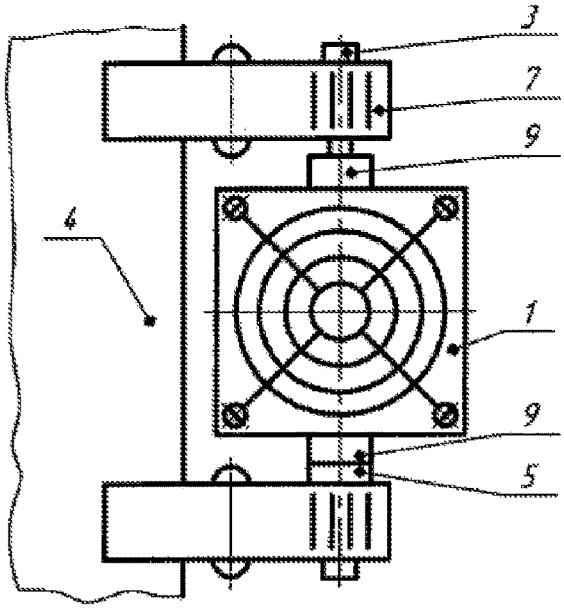

FIG. 7 is a top view of the same.

Figure 8:
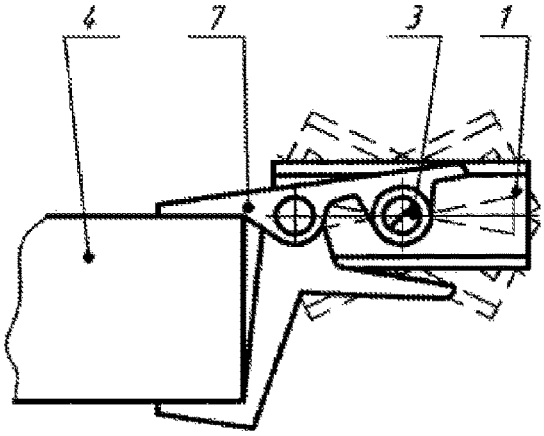

In FIG. 8 the pivot pin for tilting is raised up from the middle to the top surface of a 60 mm thick desktop, wherein " . . . is provided with a mechanism for connection to the desktop in the form of two clips positioned on both sides of the fan", wherein " . . . the rotation plane and the rotation centre of the fan pass through the pivot pin for tilting", shown in a side view.

Figure 9:
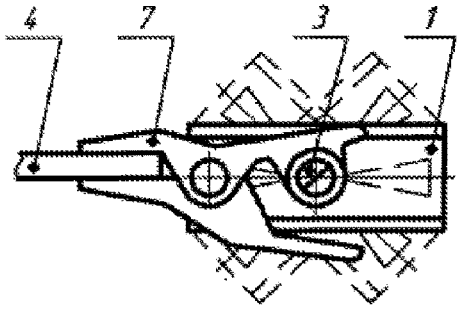

In FIG. 9 the pivot pin for tilting is lowered down from the middle to the bottom surface of an 8 mm thick desktop, wherein " . . . is provided with a mechanism for connection to the desktop in the form of two clips positioned on both sides of the fan", wherein " . . . the rotation plane and the rotation centre of the fan pass through the pivot pin for tilting", shown in a side view.

Figure 10:
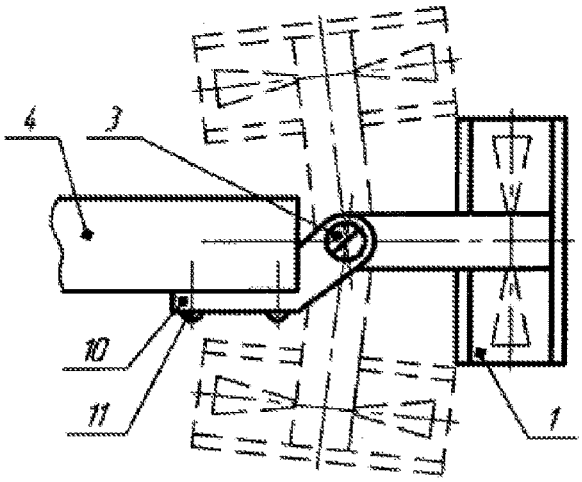

In FIG. 10 the pivot pin for tilting is positioned in the middle of a 30 mm thick desktop, wherein " . . . is provided with a mechanism for connection to the desktop in the form of a bracket with screws", wherein " . . . the rotation plane of the fan is displaced with respect to the pivot pin for tilting", shown in a side view.

Figure 11:
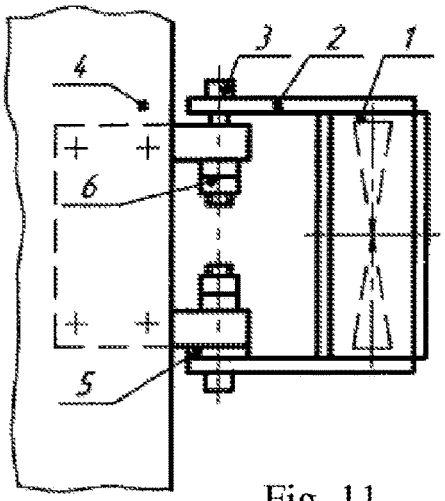

FIG. 11 is a top view of the same.

Figure 12:
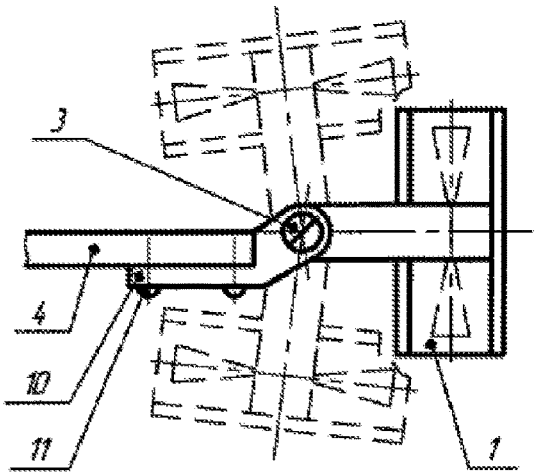

In FIG. 12 the pivot pin for tilting is raised up from the middle to the top surface of an 8 mm thick desktop, wherein " . . . is provided with a mechanism for connection to the desktop in the form of a bracket with screws", wherein " . . . the rotation plane of the fan is displaced with respect to the pivot pin for tilting", shown in a side view.

Figure 13:
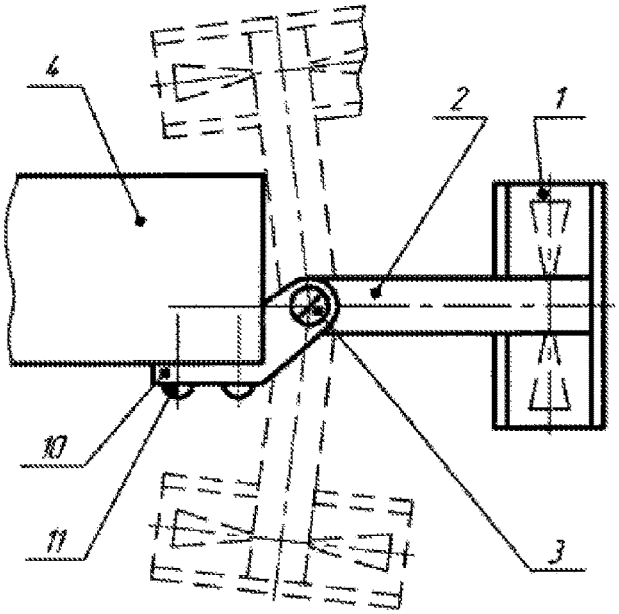

In FIG. 13 the pivot pin for tilting is lowered down by 10 mm from the middle of a 60 mm thick desktop, wherein " . . . is provided with a mechanism for connection to the desktop in the form of a bracket with screws", wherein " . . . the rotation plane of the fan is displaced with respect to the pivot pin for tilting", shown in a side view.

Figure 14:
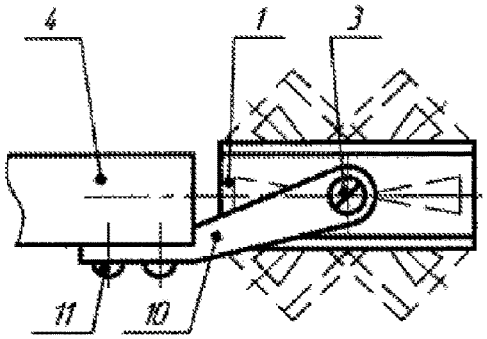

In FIG. 14 the pivot pin for tilting is positioned in the middle of a 30 mm thick desktop, wherein " . . . is provided with a mechanism for connection to the desktop in the form of a bracket with screws", wherein " . . . the rotation plane and the rotation centre of the fan pass through the pivot pin for tilting", shown in a side view.

Figure 15:
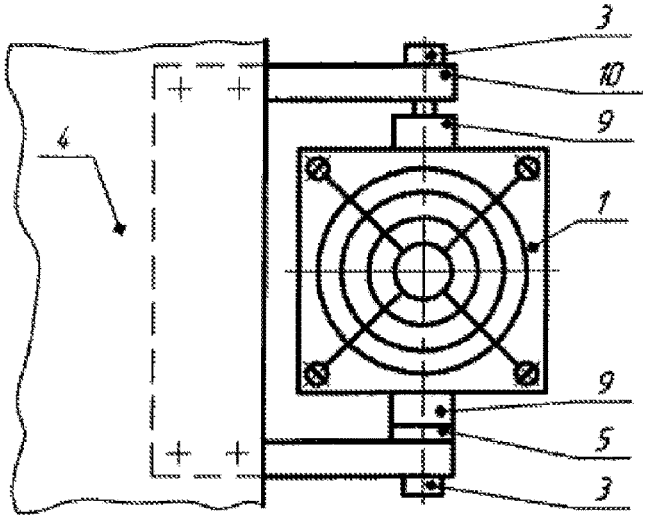

FIG. 15 is a top view of the same.

Figure 16:
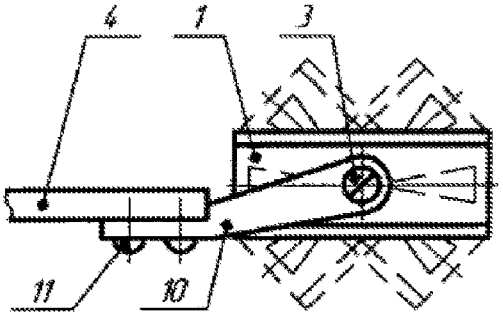

In FIG. 16 the pivot pin for tilting is raised up from the middle to the top surface of an 8 mm thick desktop, wherein " . . . is provided with a mechanism for connection to the desktop in the form of a bracket with screws", wherein " . . . the rotation plane and the rotation centre of the fan pass through the pivot pin for tilting", shown in a side view.

Figure 17:
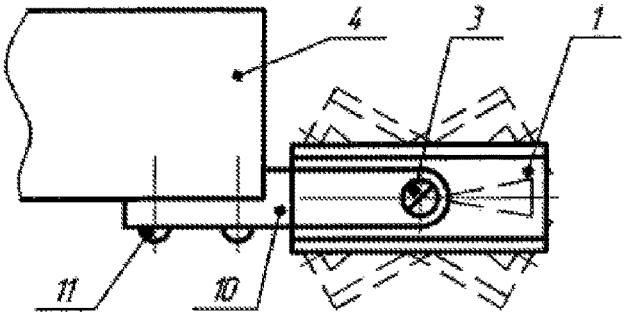

In FIG. 17 the pivot pin for tilting is lowered down from the middle to the bottom surface of a 60 mm thick desktop, wherein " . . . is provided with a mechanism for connection to the desktop in the form of a bracket with screws", wherein " . . . the rotation plane and the rotation centre of the fan pass through the pivot pin for tilting", shown in a side view.

The data proving the possibility of implementation and the operability of the fan device in all the embodiments with the achievement of the said technical effect are as follows.

Figure 1:
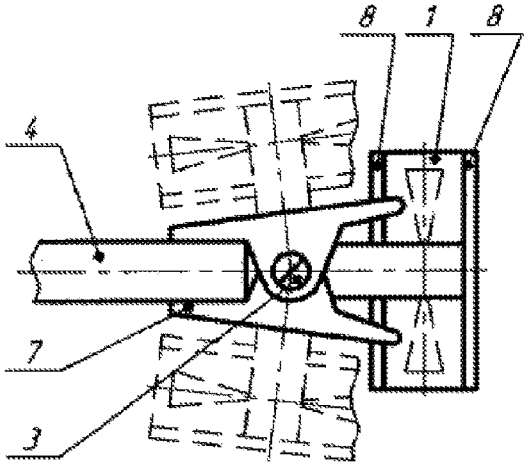
Figure 2:
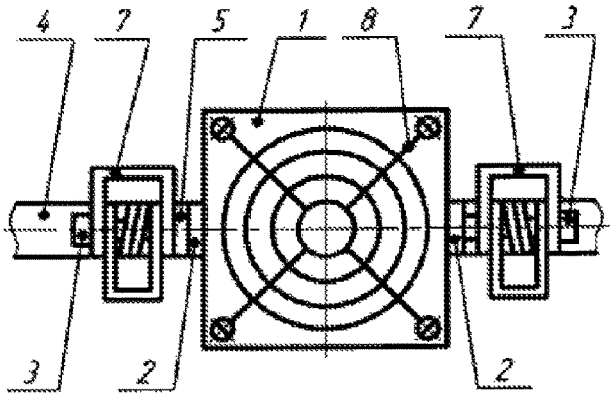
FIG. 2 is a front view of the same.
Figure 3:
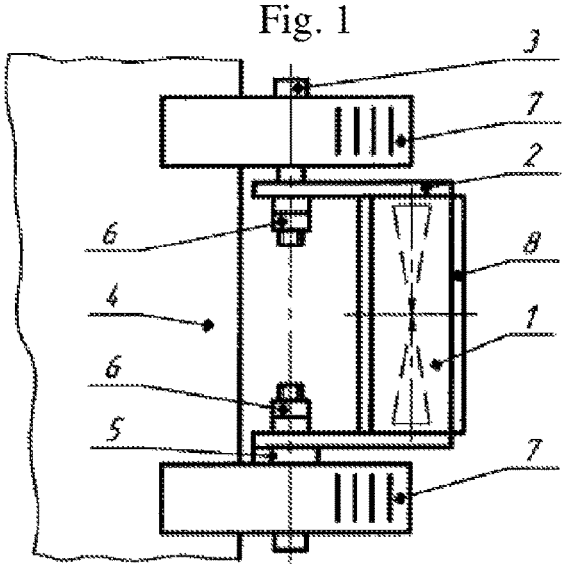
FIG. 3 is a top view of the same.

In an embodiment of an essential feature wherein the pivot pin for tilting is positioned in the middle of a 20 mm thick desktop, wherein " . . . is provided with a mechanism for connection to the desktop in the form of two clips positioned on both sides of the fan", wherein " . . . the rotation plane of the fan is displaced with respect to the pivot pin for tilting", as shown in FIG. 1, 2, 3, the fan device contains a fan 1, the fan being an instrument fan, for example, SUNON PE 20252 V1-000U-G99 with dimensions of 80×80×25 mm, performance of 102 m3/h, or other types of fans can be used, including alternating current fans, as with analogues, complying with the required dimensions and performance and provided with necessary elements for connecting to the pivot pin for tilting, the fan 1 on both sides is equipped with two eyelets 2, which are parts of the fan 1 and made by injection molding when producing the fan 1 housing, wherein the eyelets 2 are provided with openings for two semi-axes 3 for tilting in the form of screws positioned on the same axial line and performing the function of one horizontal pivot pin for tilting, wherein the rotation plane of the fan 1 is displaced with respect to the semi-axes 3 by half the thickness of the desktop 4 plus ~10 mm of the gap between the fan 1 and the desktop 4 for the intake air passage, a friction washer 5, which secures the fan 1 in any desired position when tilted, nuts 6 and lock nuts, creating a compression force of the friction washer 5 between the eyelet 2 and the side surface of the clip 7, for example, made of plastic, wherein the clips 7 in the amount of two pieces are positioned on both sides of the fan 1 and connected to the desktop 4, and the two semi-axes 3 perform an additional function of the axes connecting the upper and the lower parts of each clip 7, the fan 1 is equipped with protective grids 8, for example, Sunon Grill 80×80 FG-08/B1, www.coolera.ru on both sides, a power supply, not shown in the figure, made with flexible wires with spare length to compensate for the fan 1 movement.

The fan device operates as follows.

It is turned on by means of a power button, not shown in the figure, positioned under the desktop, either on the end of the desktop or on the fan 1, and the air flow is directed with a tilt into the desired greater part of the user area, while the air flow emerges with a 12° extension (www.innovation-grup.com.ua Air movement in ventilated rooms, pic. 2.4) and changes its direction upon contact with the user's upper body, capturing all the required part of the user area.

At the same time, the height of the fan 1 above and below the desktop in the extreme upper and lower positions is the smallest possible, less than the dimensions of the fan 1, wherein the fan 1 is positioned in the little used desktop 4 area and does not interfere with the line of sight and the user's hands as well as with the user's hips, two clips are positioned on both sides of the fan and do not interfere with passage of the air flow and the fan movements, allowing to direct the air flow to the greater part of the user area, and thereby said technical effect is achieved.

In an embodiment of an essential feature wherein the pivot pin for tilting is raised up from the middle to the top surface of an 8 mm thick desktop, wherein " . . . is provided with a mechanism for connection to the desktop in the form of two clips positioned on both sides of the fan", wherein " . . . the rotation plane of the fan is displaced with respect to the pivot pin for tilting", as shown in FIG. 4, the fan device comprises a fan 1 with eyelets 2, two semi-axes 3, a desktop 4, a friction washer 5, nuts 6 and lock nuts, clips 7 of a curved shape similar to capodaster/clip DUNLOP 88N, www.sv45.ru, and protective grids 8.

The device operates similarly to the previous embodiment.

At the same time, the height of the fan 1 above and below the desktop 4 is less than the dimensions of the fan, allowing to direct the air flow to the greater part of the user area, and thereby said technical effect is achieved.

In an embodiment of an essential feature wherein the pivot pin for tilting is lowered down by 10 mm from the middle of a 60 mm thick desktop, wherein " . . . is provided with a mechanism for connection to the desktop in the form of two clips positioned on both sides of the fan", wherein " . . . the rotation plane of the fan is displaced with respect to the pivot pin for tilting", according to FIG. 5, the fan device comprises a fan 1 with eyelets 2, two semi-axes 3, a desktop 4, a friction washer 5, nuts 6 and lock nuts, two clips 7 of a curved shape, wherein the semi-axes 3 are lowered down from the middle of the desktop, protective grids 8.

The device operates similarly to the previous embodiment.

At the same time, the height of the fan 1 above and below the desktop 4 is less than the dimensions of the fan, allowing to direct the air flow to the greater part of the user area.

In an embodiment of an essential feature wherein the pivot pin for tilting is positioned in the middle of a 30 mm thick desktop, wherein " . . . is provided with a mechanism for connection to the desktop in the form of two clips positioned on both sides of the fan", wherein " . . . the rotation plane and the rotation centre of the fan pass through the pivot pin for tilting", according to FIG. 6, 7, the fan device comprises a fan 1 tiltable to 360°, provided on both sides with eyelets 9 in the form of cylinders with threaded openings for two semi-axes 3, positioned in the rotation plane of the fan 1 and passing through its centre, a desktop 4, a friction washer 5, nuts 6 and lock nuts, clips 7, the upper parts of which are provided with additional bosses with openings for the semi-axes 3, and protective grids 8.

The device operates similarly to the previous embodiment, it is also possible to use a reversible fan, for example, SANIO DENKI, www.wexon.ru or a reversible fan www.vent—teplo.ru with symmetrical blades allowing to switch the air flow direction in the opposite direction in the horizontal position of the fan to cover more than 180° of the user area.

At the same time, the height of the fan 1 above and below the desktop 4 is the smallest possible, allowing to direct the air flow to the greater part of the user area.

In an embodiment of an essential feature wherein the pivot pin for tilting is raised up from the middle to the top surface of a 60 mm thick desktop, wherein " . . . is provided with a mechanism for connection to the desktop in the form of two clips positioned on both sides of the fan", wherein " . . . the rotation plane and the rotation centre of the fan pass through the pivot pin for tilting", according to FIG. 8, the fan device comprises a fan 1 with eyelets 9, two semi-axes 3, a desktop 4, a friction washer 5, nuts 6 and lock nuts, clips 7 with additional bosses with openings for the semi-axes 3, protective grids 8.

The device operates similarly to the previous embodiment.

At the same time, the height of protrusion of the fan 1 above and below the desktop 4 is less than the dimensions of the fan, allowing to direct the air flow to the greater part of the user area.

In an embodiment of an essential feature wherein the pivot pin for tilting is lowered down from the middle to the bottom surface of an 8 mm thick desktop, wherein " . . . is provided with a mechanism for connection to the desktop in the form of two clips positioned on both sides of the fan", wherein " . . . the rotation plane and the rotation centre of the fan pass through the pivot pin for tilting", as shown in FIG. 9, the fan device comprises a fan 1 with eyelets 9, two semi-axes 3, a desktop 4, a friction washer 5, nuts 6 and lock nuts, clips 7 with additional bosses with openings for the semi-axes 3, and protective grids 8.

The device operates similarly to the previous embodiment.

At the same time, the height of the fan 1 above and below the desktop 4 is less than the dimensions of the fan, allowing to direct the air flow to the greater part of the user area.

In an embodiment of an essential feature wherein the pivot pin for tilting is positioned in the middle of a 30 mm thick desktop, wherein " . . . is provided with a mechanism for connection to the desktop in the form of a bracket with screws", wherein " . . . the rotation plane of the fan is displaced with respect to the pivot pin for tilting", as shown in FIG. 10, 11, the fan device comprises a fan 1 with eyelets 2, two semi-axes 3, a desktop 4, a friction washer 5, nuts 6 and lock nuts, protective grids 8, a bracket 10 with two protrusions beyond the edge of the desktop 4 with openings for the semi-axes 3, screws 11 for connecting the bracket 10 to the desktop 4.

The device operates similarly to the previous embodiment.

At the same time, the height of the fan 1 above and below the desktop 4 is the smallest possible, allowing to direct the air flow to the greater part of the user area.

In an embodiment of an essential feature wherein the pivot pin for tilting is raised up from the middle to the top surface of an 8 mm thick desktop, wherein " . . . is provided with a mechanism for connection to the desktop in the form of a bracket with screws", wherein " . . . the rotation plane of the fan is displaced with respect to the pivot pin for tilting", as shown in FIG. 12, the fan device comprises a fan 1 with eyelets 2, two semi-axes 3, a desktop 4, a friction washer 5, nuts 6 and lock nuts, protective grids 8, a bracket 10 with two protrusions beyond the edge of the desktop 4 with openings raised up for the semi-axes 3, screws 11 for connecting the bracket 10 to the desktop 4.

The device operates similarly to the previous embodiment.

At the same time, the height of the fan 1 above and below the desktop 4 is less than the dimensions of the fan, allowing to direct the air flow to the greater part of the user area.

In an embodiment of an essential feature wherein the pivot pin for tilting is lowered down by 10 mm from the middle of a 60 mm thick desktop, wherein " . . . is provided with a mechanism for connection to the desktop in the form of a bracket with screws", wherein " . . . the rotation plane of the fan is displaced with respect to the pivot pin for tilting", as shown in FIG. 13, the fan device comprises a fan 1 with eyelets 2, two semi-axes 3, a desktop 4, a friction washer 5, nuts 6 and lock nuts, protective grids 8, a bracket 10 with two protrusions beyond the edge of the desktop 4 with openings lowered down for the semi-axes 3, screws 11 for connecting the bracket 10 to the desktop 4.

The device operates similarly to the previous embodiment.

At the same time, the height of the fan 1 above and below the desktop 4 is less than the dimensions of the fan, allowing to direct the air flow to the greater part of the user area.

In an embodiment of an essential feature wherein the pivot pin for tilting is positioned in the middle of a 30 mm thick desktop, wherein " . . . it is provided with a mechanism for connection to the desktop in the form of a bracket with screws", wherein " . . . the rotation plane and the rotation centre of the fan pass through the pivot pin for tilting", as shown in FIG. 14, 15, the fan device comprises a fan 1 with eyelets 9, two semi-axes 3, a desktop 4, a friction washer 5, nuts 6 and lock nuts, protective grids 8, a bracket 10 with two protrusions beyond the edge of the desktop 4 with openings for the semi-axes 3, screws 11 for connecting the bracket 10 to the desktop 4.

The device operates similarly to the previous embodiment.

At the same time, the height of the fan 1 above and below the desktop 4 is the smallest possible, allowing to direct the air flow to the greater part of the user area.

In an embodiment of an essential feature wherein the pivot pin for tilting is raised up from the middle to the top surface of an 8 mm thick desktop, wherein " . . . is provided with a mechanism for connection to the desktop in the form of a bracket with screws", wherein " . . . the rotation plane and the rotation centre of the fan pass through the pivot pin for tilting", as shown in FIG. 16, the fan device comprises a fan 1 with eyelets 9, two semi-axes 3, a desktop 4, a friction washer 5, nuts 6 and lock nuts, protective grids 8, a bracket 10 with two protrusions beyond the edge of the desktop 4 with openings for the semi-axes 3, screws 11 for connecting the bracket 10 to the desktop 4.

The device operates similarly to the previous embodiment.

At the same time, the height of the fan 1 above and below the desktop 4 is less than the dimensions of the fan, allowing to direct the air flow to the greater part of the user area.

In an embodiment of an essential feature wherein the pivot pin for tilting is lowered down from the middle to the bottom surface of a 60 mm thick desktop, wherein " . . . is provided with a mechanism for connection to the desktop in the form of a bracket with screws", wherein " . . . the rotation plane and the rotation centre of the fan pass through the pivot pin for tilting", as shown in FIG. 17, the fan device comprises a fan 1 with eyelets 9, two semi-axes 3, a desktop 4, a friction washer 5, nuts 6 and lock nuts, protective grids 8, a bracket 10 with two protrusions beyond the edge of the desktop 4 with openings for the semi-axes 3, screws 11 for connecting the bracket 10 to the desktop 4.

The device operates similarly to the previous embodiment.

At the same time, the height of the fan 1 above and below the desktop 4 is less than the dimensions of the fan, allowing to direct the air flow to the greater part of the user area.

In all the embodiments of the essential features, the fan 1 is equipped with a known control system with 1 . . . 3 speeds of rotation or a stepless speed control, a timer or other known additional functions, not shown in the figures.

Thus, the above information confirms that the invention as claimed is intended to be used at the user's table for directing the air flow to the greater part of the user area, confirms its implementability, particularly in accordance with the described algorithm for calculating raising and lowering the pivot pin for tilting for different desktop thicknesses and various fan positions with respect to the pivot pin for tilting, as well as its operability with the achievement of said technical effect in all the embodiments, consequently, it is industrially applicable.

The invention claimed is:

1. A fan device for a table of a user, comprising a fan, a pivot pin for tilting and a mechanism for connection to a desktop, characterized in that the pivot pin for tilting is positioned beyond the edge of and within the thickness of the desktop, allowing the fan to protrude maximally above and below the desktop less than the dimensions of the fan and allowing to direct the air flow to the greater part of the user area.

2. The fan device of claim 1, characterized in that the pivot pin for tilting is provided with a mechanism for connection to the desktop in the form of two clips positioned on both sides of the fan.

3. The fan device of claim 2, characterized in that the rotation plane of the fan is displaced with respect to the pivot pin for tilting.

4. The fan device of claim 2, characterized in that the rotation plane and the rotation centre of the fan pass through the pivot pin for tilting.

5. The fan device of claim 1, characterized in that the pivot pin for tilting is provided with a mechanism for connection to the desktop in the form of a bracket with screws.

6. The fan device of claim 5, characterized in that the rotation plane of the fan is displaced with respect to the pivot pin for tilting.

7. The fan device of claim 5, characterized in that the rotation plane and the rotation centre of the fan pass through the pivot pin for tilting.

* * * * *